US005249999A

United States Patent [19]

Steger

[11] Patent Number: 5,249,999

[45] Date of Patent: Oct. 5, 1993

[54] LIFE JACKET

[75] Inventor: Ralph E. Steger, Ashland, Ohio

[73] Assignee: Kent Sporting Goods Co., Inc., New London, Ohio

[21] Appl. No.: 829,714

[22] Filed: Feb. 3, 1992

[51] Int. Cl.[5] ..... B63C 9/08

[52] U.S. Cl. ..... 441/118

[58] Field of Search ..... 441/88, 89, 106, 112-119

[56] References Cited

U.S. PATENT DOCUMENTS

| | | | |
|---|---|---|---|
| 3,152,343 | 10/1964 | Brown | 441/118 |
| 3,167,794 | 2/1965 | Brown | 441/118 |
| 3,371,363 | 3/1968 | Le Blanc, Jr. | 441/118 |
| 4,934,973 | 6/1990 | Taylor | 441/117 |

FOREIGN PATENT DOCUMENTS

| | | | |
|---|---|---|---|
| 2103413 | 8/1972 | Fed. Rep. of Germany | 441/118 |

*Primary Examiner*—Jesûs D. Sotelo

*Attorney, Agent, or Firm*—Renner, Kenner, Grieve, Bobak, Taylor & Weber

[57] ABSTRACT

A life jacket of the type made from a foam buoyant material includes a transversely disposed yoke member having parallel ends which extend from the upper ends of two symmetrically opposed front panels. A body strap and a unique snap and D-ring assembly are also provided. The life jacket provides the wearer a more comfortable position at which to float while more effectively utilizing the buoyancy of the life jacket.

22 Claims, 3 Drawing Sheets

LIFE JACKET

TECHNICAL FIELD

The invention herein resides in the art of flotation devices. More particularly, the invention relates to life jackets. Specifically, the invention relates to a life jacket made of buoyant foam material having a yoke member transversely disposed to a pair of front panels such that the yoke member forms a generally U-shaped collar which protects the sides and back of the wearer's head and improves buoyancy.

BACKGROUND OF THE INVENTION

Life jackets are commonly found aboard recreational boats, ocean liners and other ships for use by the passengers and crew. Such life jackets are usually employed to keep the wearer's body afloat. A typical style of life jacket found on many vessels is a generally straight, U-shaped flotation device made of a buoyant foam which fits over the wearer's head and is secured by a strap around the wearer's waist. This style of life jacket, hereinafter referred to as the straight yoke style, is well-known as an important safety device.

Several problems with the straight yoke style life jacket have long been recognized. First, it is well known that only that part of the flotation device or life jacket which is actually in the water provides buoyancy. Accordingly, the portion of the straight yoke style of life jacket located behind the wearer's head provides little buoyancy inasmuch as that portion generally is out of the water when the life jacket is being utilized.

Secondly, the straight yoke style of life jacket may not permit the wearer to float at a comfortable angle. Specifically, the wearer must either force the front part of the life jacket down into the water to enable him to float in an upright position, or he must float on his back with his head bent upward as promoted by the life jacket. In either situation, the wearer's head is forced forward because of the restrictive nature of the life jacket.

Thirdly, different sizes of life jackets are necessary because of the various head and neck sizes of the wearers. One size does not fit all. A person with a small head and neck, such as a child, should not wear an adult life jacket because his head could slip through to an unsafe level or perhaps even out of the head hole provided. Conversely, a person with a large head or neck would likely not fit into a life jacket with a smaller head hole, and even if the person did get the life jacket on, its function would be inadequate.

Fourthly, the straight yoke style of life jacket severely restricts the head motion of the wearer while not providing any protection from waves or debris which may be directed towards him. The head hole in the life jackets of the prior art acts as a neck brace and substantially prohibits the wearer from turning his head. Hence, the wearer is always in danger of being hit by waves or unseen objects.

Fifthly, the wearer is likely to be extremely confused about which way the life jacket should be worn. The front and the back of the straight yoke style life jacket are almost exactly alike. While the way the life jacket is worn may be of little consequence once in the water, the time involved in determining which is the front or back and the convenience associated with putting the jacket on many be important. Putting the life jacket on backwards would be more awkward and time consuming than putting it on correctly.

Finally, a common problem with the straight yoke style life jacket is that the buckle attached to the strap may easily be removed. Many times passengers will take the buckle as a memento from the ship. Thus, when the life jackets are actually needed, many are found without the buckle to properly secure the strap around the wearer's waist.

Therefore, a need exists for a life jacket having an angled yoke which overcomes these and other problems as set forth above.

DISCLOSURE OF THE INVENTION

In light of the foregoing, it is a first aspect of the invention to provide a life jacket having an angled yoke.

Another aspect of the invention is to provide a life jacket, as above, which most effectively utilizes its buoyancy potential.

A further aspect of the invention is to provide a life jacket, as above, which permits the wearer to float in a substantially upright and leaning backward position without having to generally force the front of the life jacket down into the water.

Still another aspect of the invention is to provide a life jacket, as above, wherein the head hole of the life jacket is of a sufficient size and design such that one size fits all individuals weighing over 50 lbs.

Still a further aspect of the invention is to provide a life jacket, as above, which permits some freedom of head movement.

Yet another aspect of the invention is to provide a life jacket, as above, which shields and protects the back of the wearer's head as well as the sides of his face.

Yet a further aspect of the invention is to provide a life jacket, as above, which is not reversible so that no confusion exists as to which way to wear the life jacket.

Yet an additional aspect of the invention is to provide a life jacket, as above, wherein the buckle used to secure the strap around the wearer's waist is fixed to the front of the life jacket.

The foregoing and other aspects of the invention which will become apparent as the detailed description proceeds are achieved by a life jacket, comprising: first and second elongated panels; a yoke member connecting said first and second panels and extending orthogonally from first ends of the panels; and a means for releasably securing the first and second panels together.

Other aspects of the invention which will become apparent herein are attained by a life jacket, comprising: first and second elongated panels, each having upper and lower ends; a yoke member transversely disposed to said panels having first and second ends connected to said upper ends of said panels; and a means for releasably securing said first and second panels together.

DESCRIPTION OF THE DRAWINGS

For a complete understanding of the objects, techniques and structure of the invention, reference should be made to the following detailed description and accompanying drawings wherein.

BEST MODE FOR CARRYING OUT THE INVENTION

Figure 1:
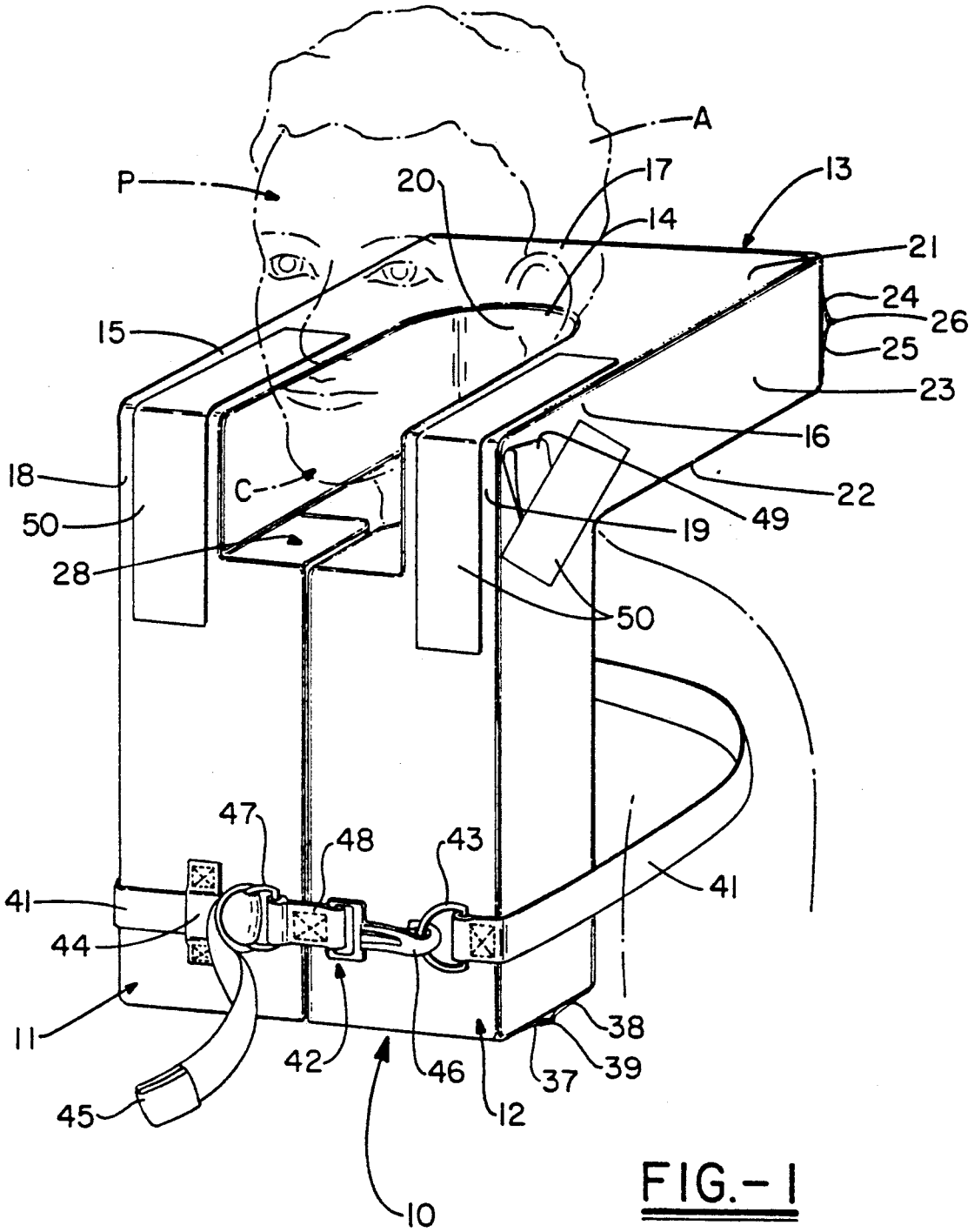
FIG. 1 is a perspective view of a life jacket according to the invention fitted on a person drawn in phantom.
Figure 2:
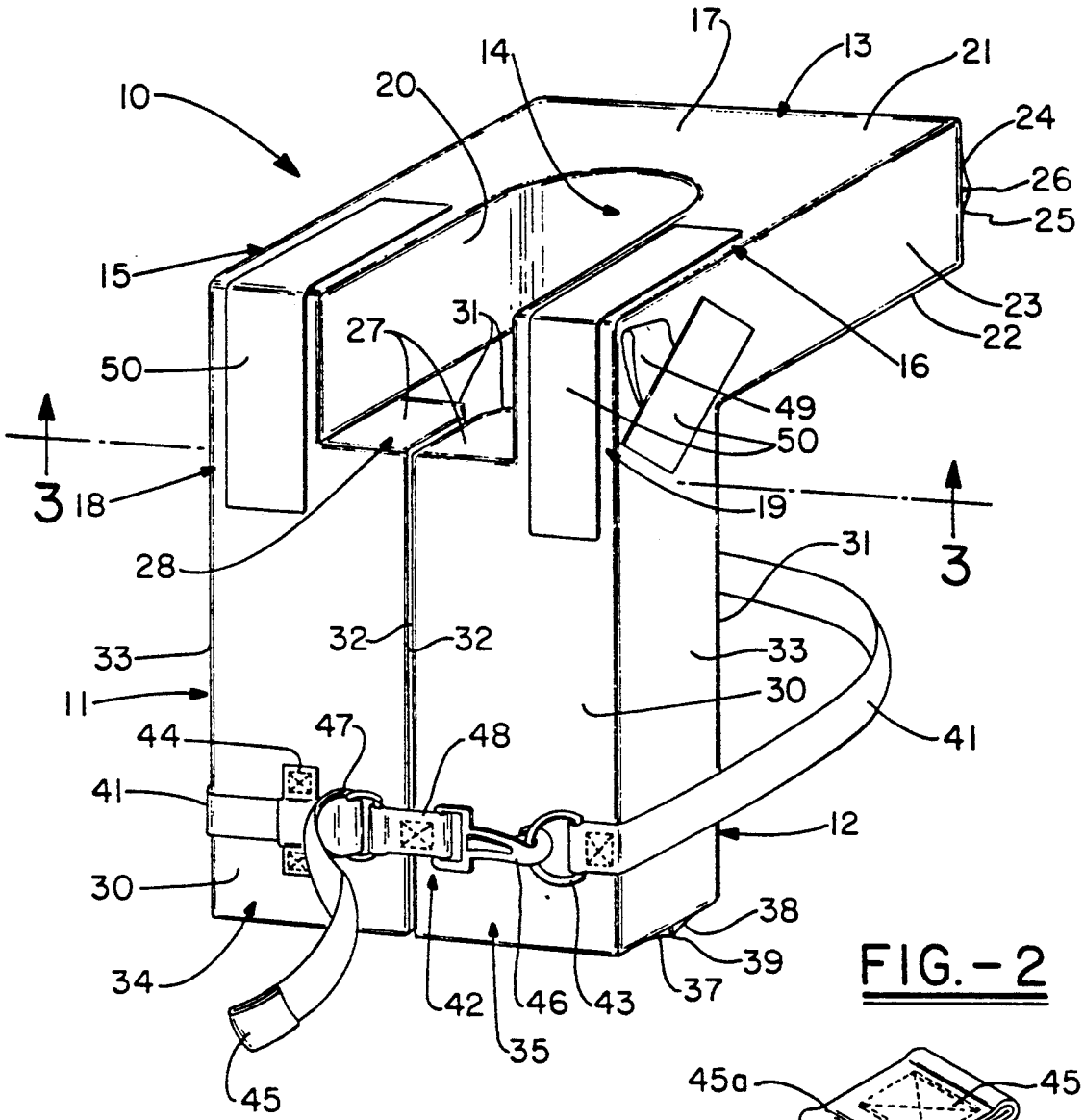
FIG. 2 is a perspective view of the life jacket of FIG. 1.

A life jacket embodying the concepts of the present invention is generally designated by the numeral 10 in the drawings. The life jacket 10 is unique in that it includes a pair of elongated panels 11 and 12 connected by a yoke member 13 extending transversely or orthogonally from the like ends of each panel 11 and 12. As can be seen in FIGS. 1 and 2, the transverse yoke member 13 forms a collar 14 which generally encompasses the back and sides of the head A of the person P wearing the life jacket 10. Because of its orientation with respect to the panels 11 and 12, the yoke member 13 further provides buoyancy at the back of the life jacket 10.

As more particularly depicted in FIG. 2, the yoke member 13 generally includes a first end 15 and a second end 16 which are substantially parallel to each other and are connected by a back portion 17. The ends 15 and 16 are connected to the upper ends 18 and 19 of the panels 11 and 12, respectively. Furthermore, the ends 15 and 16 of the yoke member 13 are spaced apart by the collar 14, which is preferably U-shaped, and is generally defined by the inside face 20 of the yoke member 13.

The general structural configuration of the yoke member 13 is determined by the configuration of the top face 21 which is substantially parallel to the bottom face 22 thereof. In the preferred embodiment, the configuration of the yoke member 13 and its top and bottom faces 21 and 22 is defined by the inside face 20 and the outside face 23. The top face 21 and bottom face 22 both have a generally U-shaped inside edge defined by the inside face 20 as was indicated hereinabove in describing the collar 14, and have a generally rectangular outside edge as defined by the outside face 23 of the yoke member 13 which defines the periphery of the part of the life jacket 10. Moreover, the top face 21 and the bottom face 22 are separated by the width of the inside face 20 and the outside face 23.

A part of the outside face 23 at the back portion 17 of the yoke member 13 includes two flaps 24 and 25 which are integrally connected to the top face 21 and the bottom face 22, respectively, of the yoke member 13 and which are folded over and secured together at seam 26.

As seen in the drawings, the life jacket 10 has a longitudinal plane of symmetry running between the first panel 11 and the second panel 12 such that each panel is substantially a mirror image of the other. Therefore, it should be understood that the panels 11 and 12, as detailed hereinbelow, have symmetrically opposite features with respect to this plane of symmetry.

Each panel 11 and 12 has an upper end 18 and 19 which is connected to the first and second parallel ends 15 and 16 of the yoke member 13, respectively. Generally, the panels 11 and 12 have a cross-sectional width greater than the width of the ends 15 and 16 of the yoke member 13. Consequently, an upper face 27 on the panels 11 and 12 is disposed between the ends 15 and 16 of the yoke member 13. As shown in FIG. 1, when a person P is using the life jacket 10, the upper faces 27 of the panels 11 and 12 are adjacent to each other in substantially the same lateral plane and thus, give the person P a platform 28 on which his chin C may rest.

Figure 3:
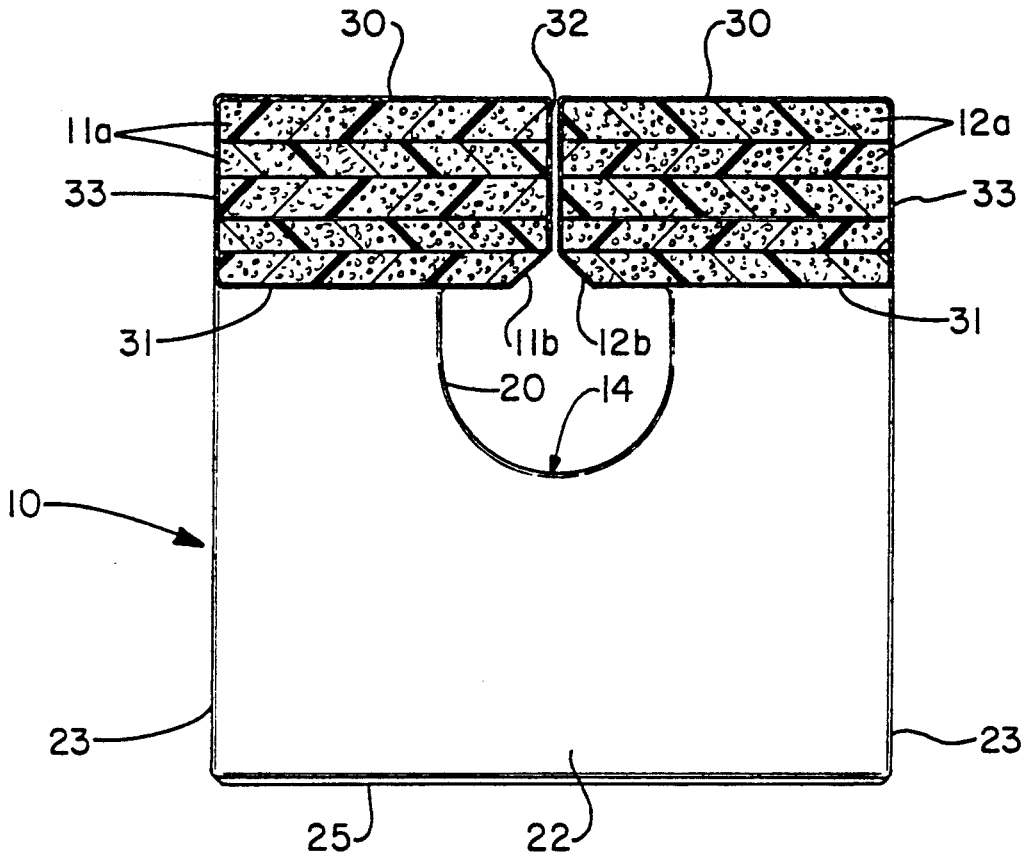
FIG. 3 is a cross-sectional view of the life jacket taken along the line 3—3 of FIG. 1.

Continuing with respect to the panels 11 and 12, they may have any structural configuration known in the art which will accomplish the objects of the present invention. Preferably, panels 11 and 12 have generally rectangular cross-sections as depicted in FIG. 3. Hence, each panel 11 and 12 has two pairs of parallel faces, one pair separating the other pair, and all four defining the preferred cross-sectional structure of the panels. These faces include a front face 30 parallel to a back face 31 and an inside face 32 parallel to an outside face 33. Because of the structural symmetry of the panels 11 and 12, it is noted that the inside faces 32 of each panel 11 and 12 oppose each other and will contact each other when the panels 11 and 12 are adjacent to one another.

The exact configuration of each face of the panels 11 and 12 may be of any geometry commonly known in the art. In the preferred embodiment, the back faces 31, inside faces 32 and outside faces 33 are all substantially rectangular. The front faces 30, while generally rectangular with respect to the panels 11 and 12, include an additional portion at the upper ends 18 and 19 of the panels 11 and 12 which has a configuration similar to the cross-section of the ends 15 and 16 of the yoke member 13. The ends 15 and 16 of yoke member 13 terminates at the front faces 30 of panels 11 and 12.

The lower ends 34 and 35 of each panel 11 and 12 terminate at a bottom face 36 which includes two flaps 37 and 38 integrally connected to the front faces 30 and the back faces 31, respectively, of each panel 11 and 12 which are folded over and secured together at seam 39.

Further comprising the life jacket 10 is a body strap 41 and a snap and D-ring assembly 42 for releasably securing the panels 11 and 12 together. Any type of material known in the art, preferredly UL listed, will suffice for the body strap 41.

Figure 4:
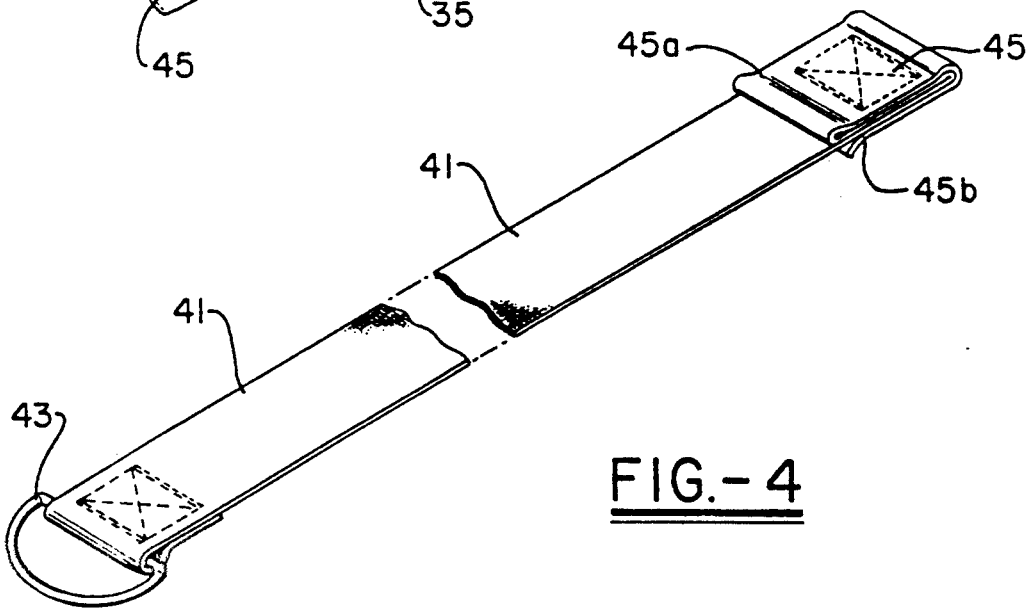
FIG. 4 is a partial perspective view of a body strap of the invention.

As best depicted in FIG. 4, such a body strap 41 should be of a sufficient length such that it may be wrapped around a person's waist. One end of the strap 41 may be folded over and attached to itself, so as to fasten a connection means 43 such as a D-ring thereto. The body strap 41 is then positioned through a belt loop 44 attached to the front face 30 of one of the panels 11 or 12. The end of the strap 41 having the D-ring 43 may be pulled around the waist of the person using the life jacket 10 and connected to the snap and D-ring assembly 42 as provided hereinbelow.

At the other end of the strap 41 is a reversible double tab 45. It will be appreciated that this double tab 45, comprising tabs **45*a* and 45*b*, is made from one piece and has been created essentially by weaving the strap 41 back and forth and stitching one part of the weave together. This tab 45 prohibits the strap 41 from sliding through a slip means or D-rings 47 which is also part of the snap and D-ring assembly 42**.

Figure 5:
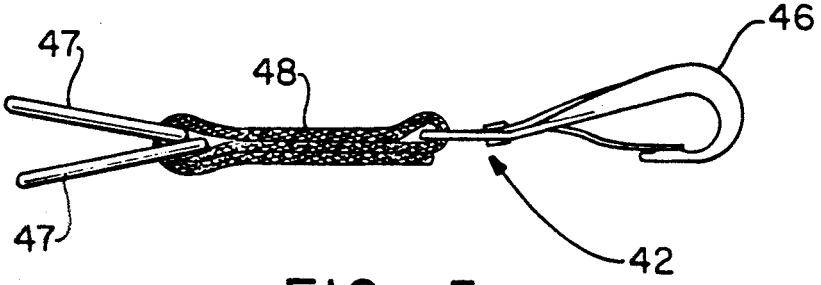
FIG. 5 is a side plan view of a snap and D-ring assembly according to the present invention.

With reference to FIG. 5, the preferred snap and D-ring assembly 42 includes a snap hook or buckle 46, and slip means such as a pair of D-rings 47 connected to opposite ends of a material 48 similar to the material of the body strap 41. It will be appreciated that the preferred snap and D-ring assembly 42 is unique in that the snap hook or buckle 46 is not affixed to the body strap 41, but rather to the front 30 of one of the panels 11 or 12. More particularly, the buckle 46 is attached to the piece of material 48 which is attached to the front face 30 of one of the panels 11 or 12. Hence, the snap and D-ring assembly 42 cannot be removed. To the other end of the material 48 is fastened a slip means or pair of D-rings 47 for holding the strap 41.

It will be apparent to those skilled in the art that any means of attaching the belt loop 44 or the snap and D-ring assembly 42 to the panels 11 may be employed. In the preferred embodiment, the articles are stitched to the life jacket 10, using a Box-X stitch. The same stitch may also be used to attach the end of the body strap 41 to itself and to stitch the weave of the double tab 45 together.

The life jacket 10 may also include a light loop 49 attached anywhere of convenience on the life jacket 10. Preferably, the light loop 49 is attached by stitching on the outside face of the life jacket 10 where the yoke member 13 meets the panels 11 and 12.

It will be appreciated by those skilled in the art that various sizes and shapes of retroreflective material 50, preferably USCG approved, may be attached to the life jacket 10. For example, the preferred life jacket 10 has retroreflective material 50 positioned on the outside faces and the top and front faces of the life jacket 10 where the yoke member 13 and the panels 11 and 12 connect.

It will readily be appreciated by those skilled in the art that the life jacket 10 of the present invention may be made from any stiff buoyant material commonly used in flotation devices. Preferredly, UL-listed PE foam, a lightweight buoyant foam, is employed, usually in the form of inserts having layers with ¼ inch to 5/16 inch nominal thickness and having a "V" factor of 98 or above which are encased in a fabric, such as nylon, that is stitched together so as to take the shape of the life jacket 10 when the manufacturing process is complete. The elongated panels 11, 12 and the yoke 13 may be individually formed from single blocks of PE foam, or from the layers as just discussed. In FIG. 3, the panels 11 and 12 are shown as comprising a plurality of layers of foam board 11*a* and 12*a*. The foam boards 11*a* and 12*a* are far more flexible than the single blocks of foam, both individually and as a unit. Thus, the boards 11*a* and 12*a* make it much easier for the user to pull apart the panels 11 and 12 and place the life jacket 10 over his or her head. In addition, it will be appreciated that the inserts used in the life jacket 10 do not necessarily have to conform to the exact shape or to the entire portion of the features described. For example, the yoke member 13 as described hereinabove does not have to have one insert which conforms to the description thereof.

It is further contemplated as a portion of the invention that the corners of the panels 11, 12 in communication with the throat of the user P may be removed by bevelling or rounding of the block 11*a* and/or boards 12*a* as at 11*b*, 12*b*, respectively. Accordingly, no corners are incident to the throat of the person P, but only rounded surfaces.

In use, the panels 11 and 12 of the life jacket 10 may be pulled apart so that a larger area between the ends 15 and 16 of the yoke member 13 is created. A person's head A may then be received by the collar 14 of the yoke member 13. As is apparent in FIG. 1, it will be appreciated that the life jacket 10 does not push the head A forward.

The panels 11 and 12 may then be pushed together in front of person P and the strap 41 placed around the person's waist. The body strap 41 may then be connected to the snap and D-ring assembly 42, and more particularly, to the snap hook 46 itself. To tighten the body strap 41 around the person's waist, one should simply pull on the other end of the body strap 41, namely that end comprising the double tab 45. The slip means 47 may be manipulated to keep the strap 41 from loosening.

The life jacket 10 as properly worn is thus depicted in FIG. 1. The life jacket 10 is of a style having an angled yoke. Preferredly, the yoke member 13 is substantially orthogonal to the panels 11 and 12. This angled yoke style of life jacket permits the person wearing the life jacket to float at a stable flotation angle, namely in a substantially upright and slightly backward position. Specifically, the life jacket 10 is provided with improved buoyancy utilization because the yoke member 13 behind the person's head A may easily contact the water. Therefore, more of the life jacket 10 is in contact with the water when in use, and hence, a more effective use of the buoyancy characteristics of the life jacket 10 is obtained.

Further, it will be readily apparent that the design of the life jacket 10 provides other benefits as well. Specifically, the collar 14 of yoke member 13 encompasses the sides and back of the head A of the person P wearing the life jacket 10. This protects the person from waves and debris which may strike the person while he is in the water. Additionally, the upper faces 27 of the panels 11 and 12 form a chin platform 28 for the life jacket 10. As is readily apparent from FIG. 1, the chin C on a person P may rest on the chin platform 28 without choking the neck of the person P. Further, if necessary, the back or side of the person's head A can rest against the collar 14 of the yoke member 13.

It will also be appreciated that once the life jacket 10 is properly adjusted and secured, the person's head A cannot be removed from the life jacket 10 without loosening the body strap 41 and pulling apart the panels 11 and 12. This is because a much smaller opening is provided as opposed to the straight yoke style life jacket, as is readily apparent from FIG. 3. This smaller opening is possible, in part, because the opening is substantially coaxial with the neck of the person P. Further, the chin platform 28 causes the opening to be basically semicircular, precluding inadvertent passage of the substantially spherical head of the person P. Thus, the head A of the person P wearing the life jacket 10 cannot easily slip out of the life jacket 10 no matter what the person's head size is. Moreover, while the head may be prevented from slipping out of the life jacket 10, it is not prevented from moving. In fact, the life jacket 10 is much less restrictive with respect to the turning of the head than are the life jackets of the prior art.

Furthermore, it is readily apparent that the life jacket 10 is not reversible and, hence may be put on in an uncomplicated manner. The easily accessible snap hook 46 on the front of the life jacket 10 further provides an easy securing mechanism for the life jacket 10.

Finally, it will be appreciated that a plurality of life jackets 10 may be easily stacked in a neat arrangement simply by tilting one life jacket 10 against the wall such that the panels 11 and 12 are inclined upwardly toward the wall. The next life jacket 10 is then placed in a similar position such that the front faces 30 of panels 11 and 12 of the second life jacket 10 contact the back faces 31 of the panels 11 and 12 of the first life jacket 10 and so on.

Thus it can be seen that the objects of the invention have been satisfied by the structure presented above. While in accordance with the patent statutes only the best mode and preferred embodiment of the invention has been presented and described in detail, it is to be understood that the invention is not limited thereto or thereby. Accordingly, for an appreciation of the true scope and breadth of the invention, reference should be made to the following claims.

What is claimed is:

1. A life jacket, comprising:

first and second elongated panels;

a yoke member connecting said first and second panels, said yoke member forming a generally U-shaped collar and extending fixedly orthogonally from first ends of said panels;

a chin platform defined upon said first ends of said panels at an open end of said collar, said collar defining a receptacle receiving, encompassing, and protecting a portion of a person's head when such person's chin is received upon said chin platform; and means for releasably securing said first and second panels together.

2. A life jacket according to claim 1, wherein said first and second panels are mirror images of each other with respect to a longitudinal plane between them.

3. A life jacket according to claim 1, wherein said means for releasably securing comprises a body strap and a snap and D-ring assembly.

4. A life jacket according to claim 3, wherein said snap and D-ring assembly is affixed to one of said panels.

5. A life jacket according to claim 4, wherein said snap and D-ring assembly includes a piece of material similar to said body strap which is stitched to said one of said panels with a snap hook attached to one end of said material and a pair of D-rings attached to the other end of said material.

6. A life jacket according to claim 4, wherein said means for releasably securing further comprises a belt loop attached to the other of said panels, for said body strap to be positioned therethrough.

7. A life jacket according to claim 3, wherein said strap has a pair of tabs at one end which are made from a continuous piece of said body strap, said tabs opening away from opposite sides of said body strap and away from said one end, said tabs preventing said body strap from removal from said D-ring assembly.

8. A life jacket according to claim 1, further comprising a light loop attached to an outside face of the life jacket.

9. A life jacket according to claim 1, further comprising retroreflective material attached to the life jacket.

10. A life jacket according to claim 1, wherein said elongated panels and yoke member are individually formed by foam boards which provide flexibility to the life jacket.

11. A life jacket according to claim 10, wherein said elongated panels have bevelled or rounded surfaces in communication with the throat of a user.

12. A life jacket, comprising:

first and second elongated panels, each having upper and lower ends;

a yoke member fixedly and transversely disposed to said panels having first and second ends connected to said upper ends of said panels;

a means for releasably securing said first and second panels together; and wherein said elongated panels and yoke member are each formed of a plurality of individual foam boards, providing flexibility to the life jacket.

13. A life jacket according to claim 12, wherein said yoke member forms a generally U-shaped collar.

14. A life jacket according to claim 13, wherein said first and second ends of said yoke member have a smaller width than said upper ends of said panels, thereby providing a chin platform, said U-shaped collar providing a receptacle for receiving, encompassing, and shielding a portion of a person's head when such person's chin is received upon said chin platform.

15. A life jacket according to claim 12, wherein said first and second panels are mirror images of each other with respect to a longitudinal plane between them.

16. A life jacket according to claim 12, wherein said first and second ends of said yoke member are integrally connected to said upper ends of said first and second panels.

17. A life jacket according to claim 12, wherein said means for releasably securing comprises a strap and a buckle and D-ring assembly.

18. A life jacket according to claim 17, wherein said buckle and D-ring assembly is affixed to one of said panels.

19. A life jacket according to claim 18, wherein said means for releasably securing further comprises a belt loop affixed to the other of said panels, for said strap to be positioned therethrough.

20. A life jacket according to claim 17, wherein said strap has a pair of tabs at one end which extend from opposite sides of said strap and open away from said one end, said tabs adapted to engage and prevent removal from said D-ring assembly.

21. A life jacket according to claim 12, further comprising a light loop attached to an outside face of the life jacket.

22. A life jacket according to claim 12, further comprising retroreflective material attached to the life jacket.

* * * * *